US006023822A

United States Patent [19]

Luebke

[11] Patent Number: 6,023,822

[45] Date of Patent: Feb. 15, 2000

[54] PET CREMATORY URN

[76] Inventor: William Luebke, 13043 Mercury Dr., Littleton, Colo. 80124

[21] Appl. No.: 09/053,540

[22] Filed: Apr. 1, 1998

[51] Int. Cl.[7] ..... A61G 17/00

[52] U.S. Cl. ..... 27/1

[58] Field of Search ..... 27/1; D99/5, 19; 446/73, 74, 268, 369

[56] References Cited

U.S. PATENT DOCUMENTS

| | | | |
|---|---|---|---|
| 1,558,278 | 10/1925 | Phillips . | |
| 1,660,085 | 2/1928 | Nassau . | |
| 2,618,892 | 11/1952 | Locks et al. . | |
| 4,816,000 | 3/1989 | Hsu | 446/74 |
| 5,326,300 | 7/1994 | Sonders | 446/74 |
| 5,386,909 | 2/1995 | Spector | 446/73 X |
| 5,676,583 | 10/1997 | Wang et al. | 446/268 |
| 5,702,003 | 12/1997 | Springer | 446/73 X |

*Primary Examiner*—Terry Lee Melius
*Assistant Examiner*—William L. Miller
*Attorney, Agent, or Firm*—Lee G. Meyer; Patton Boggs, LLP

[57] ABSTRACT

A pet crematory receptacle having a decorative housing in the general form of, and preferably the likeness of, the deceased pet containing at least one internal sealable chamber having an opening for receiving the cremated remains of the deceased pet. The chamber is adopted to receive the crematory ashes and has an opening capable of being closed by a cover, preferably disposed in the base of the urn. The sealable chamber is adapted to receive a sealed container which houses the cremated remains. The urn, can contain a strategically positioned receptacle or place to accept memorabilia of the deceased pet such as a plaque or picture.

13 Claims, 2 Drawing Sheets

PET CREMATORY URN

BACKGROUND OF THE INVENTION

1. Field of the Invention

This invention relates generally to crematory urns and particularly to stylized crematory urns for pets.

2. Description of Related Art

Cremation has long been known as a method for providing for a final resting place, as well as memorializing the remains of the body of the deceased. Throughout history, vases, jars and urns have been used as a repository for the cremated remains of individuals. Many such retainers are ornate, being made of valuable metal with jewels and the like, as a tribute to the life of the person whose cremated remains are contained within the vessel.

Recently, owners of pets such as dogs and cats, and even horses, have become very emotionally attached to these animals. The pet industry has exploded in recent years. Whole chains are dedicated to pet food and paraphernalia. The U.S.'s fascination with pets has lead to the involvement of pets in all aspects of life. Owners provide for their care in elaborate and exorbitant ways, including polishing of nails, etc. The area of veterinary medicine also has exploded in the, so called, small animal area which caters primarily to house pets. This is so much the case that pets are enshrined, included as sole beneficiaries in wills and the like.

More recently, the practice of formally burying pets has come to the forefront with the sale of pet burial plots in pet cemeteries becoming a formible business enterprise which caters to bereaved pet owners. These practices may involve, for example, memorial services, caskets and the like in an attempt to replicate human burial ceremonies. More recently crematoriums have catered to bereaved pet owners, allowing the pet remains to be cremated and then either spread in a fitting ceremony or retained in a crematory urn which is given a special place in the home of the pet owner.

Many urns are expensive and ornate, but in some ways do not fittingly memorialize the pet whose cremated remains are contained therein. It would therefore be desirable to have an urn to hold the cremated remains of the pet which performs functionally the time honored duty of a last residence of the cremated remains, but is formed in the replica of the animal whose remains are contained therein. For example, certain breeds of dogs and or types of cats remains could be encapsulated in an urn that has a physical resemblance or even a likeness of the animal.

The prior art is replete with various improvements to urns. For example, U.S. Pat. No. 2,562,726 teaches a urn for ashes with a screw in stopper. U.S. Pat. Nos. 2,385,520; 2,235,617; and 2,075,859 teach ash urns with a screw-in stoppers. U.S. Pat. No. 4,324,026 teaches a ashes urn with compartment for memorabilia of the deceased. U.S. Pat. No. 232,782 teaches an ashes urn formed as a statue or bust. All of the above referenced art is with respect to vessels for human remains and not animals and specifically pets.

SUMMARY OF THE INVENTION

This invention provides an improved receptacle or urn for the reception of the ashes resulting from cremation of bodies of deceased pets such that the ashes may be securely and conveniently preserved for an indefinite period. In accordance with the invention a pet crematory urn is constructed in the form of a replica statue, and preferably a likeness, of the deceased pet whose ashes are to be preserved therein.

The urn, of the instant invention, is hollow or is proved with a suitable recess or chamber in the back or other portion of the statue for the reception of a container housing the cremation ashes or the loose ashes themselves. The chamber opening has a cover that may be secured to removably seal the chamber. Preferrably, the cover is concealed from view. In one embodiment, a plaque or plate can be appropriately placed upon the exterior of the urn to contain, any suitable inscription in regard to the birth, life, character, and death of the pet.

In accordance with the broad aspect, a cremation urn comprising a decorative housing in the general form of the deceased pet, whose cremated remains are contained therein, said housing having at least one internal sealable chamber for receiving the cremated remains. The chamber adopted to receive the crematory ashes, having at least one opening, is capable of being closed by a cover, preferably disposed in the base of the urn. In one embodiment, the sealable chamber is adapted to receive a sealed container which houses the cremated remains. In another embodiment, the remains are inserted directly into the sealable chamber and remain loose therein. In still another embodiment, the replication of the pet, comprising ornamentation of the urn, can contain thereupon a strategically positioned receptacle or place to accept memorabilia of the deceased pet such as a plaque or picture. In another embodiment, a collar receiving position is placed proximate the neck of the animal to receive the collar of the deceased pet.

DESCRIPTION OF THE PREFERRED EMBODIMENT

Figure 1:
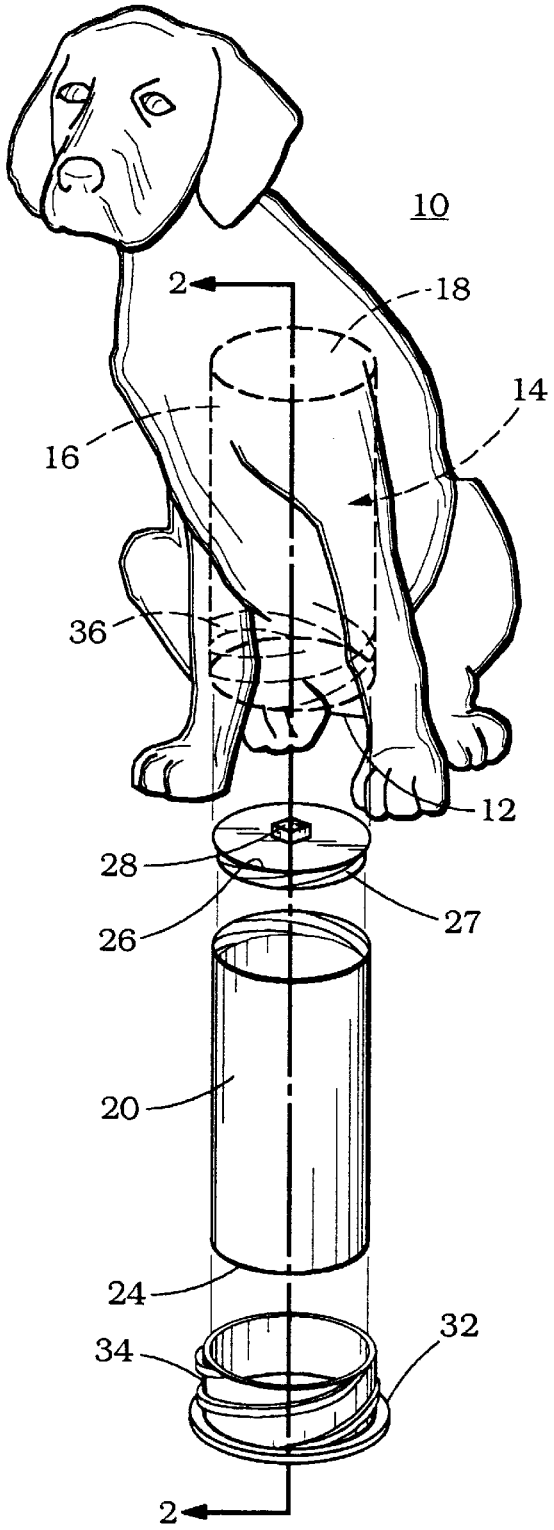
FIG. 1 is a front perspective exploded view of the pet crematory urn with the sealable chamber in phantom.

A pet cremation urn 10 in the general form of a dog according to the present invention comprises a base section 12 and a sealable receptacle or chamber 14 within torso portion of urn 10. The chamber 14 comprises a side wall cylindrical portion 16 and a top wall 18 which form the chamber 14 within the pet cremation urn 10. The chamber 14, which is open at its bottom portion is sized to contain either the sealable container 20 or the cremated remains 30 of the deceased pet (not shown).

Figure 2:
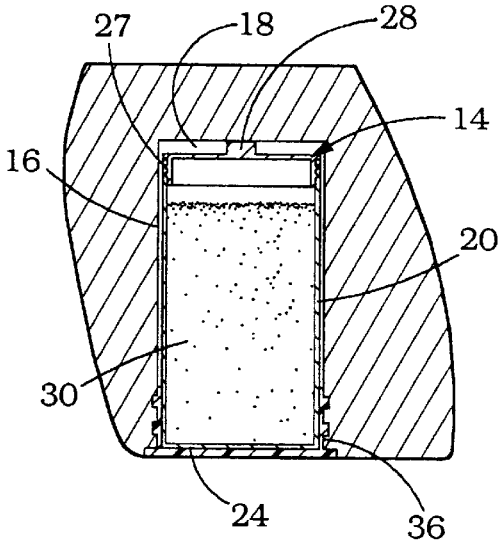
FIG. 2 is a cutaway view of FIG. 1 along lines 2—2 showing the relationship of the ash containing canister within the sealable chamber.
Figure 3:
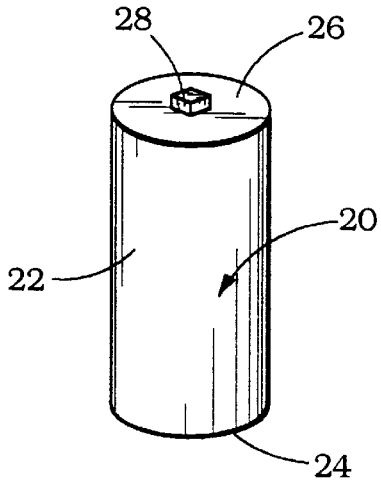
FIG. 3 is a perspective view of the sealed canister for containing the cremated remains.

Preferably, the cremated remains 30 are housed in a sealable container 20, as better seen in FIG. 3, which is adapted to slidably reside in chamber 14 as seen in FIG. 2. The sealable container 20 comprises a side wall cylindrical portion 22 and a bottom wall 24 which forms the sealable container 20. The sealable container 20, which has an opening at its top portion is sized to contain the cremated remains 30 of the deceased. The upper portion of the sealable container 20 forms a female connector 27 which receives a cannister male connector screw plug 26 and can be tightened by, for example wrench nut 28.

In operation, the empty sealable container 20 is filed with cremated remains 30 of the deceased pet from the open top portion of sealable container 20. The cannister male connector screw plug 26 is placed in engagement with female connector 27 and rotatably tightened to form a secure, sealed container 20 containing cremated remains 30.

As shown in FIG. 1, the lower portion of chamber 14 forms a threaded female connector 36 which receives a chamber male connector screw plug 32 having a male treaded portion 34 into the base section 12. Thus, the sealed container 20 containing cremated remains 30 is inserted into chamber 14 and chamber male connector screw plug 32 is rotatably tightened to form a sealed chamber 14 containing sealable container 20 with cremated remains 30 as seen in FIG. 2. The chamber male connector screw plug 32 is thus concealed from view when the urn is placed in its upright position.

Figure 4:
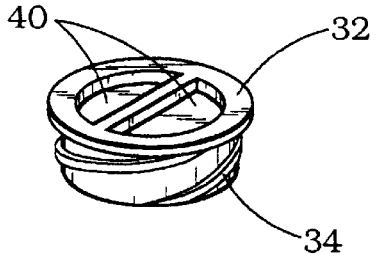
FIG. 4 is a perspective view of a screw type cap for the sealable chamber.
Figure 5:
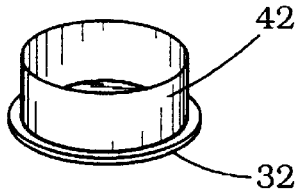
FIG. 5 is a perspective view of a pressure fit cap for the sealable chamber.

In accordance with a preferred embodiment, as shown in FIG. 4, chamber male connector screw plug 32 having a male treaded portion 34 has finger tightening slots 40 recessed in the top portion of chamber male connector screw plug 32 for ease of insertion. As shown in FIG. 5, the chamber male connector screw plug 32 can also be configured as a pressure or friction fit insertion stopper. According to this aspect, the smooth side walls are adapted to fit the unthreaded inside walls of chamber 14 to provide a friction seal there between (not shown).

Figure 6:
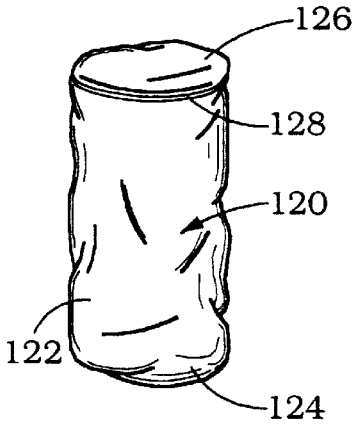
FIG. 6 is a perspective view of a malleable, flexible container for containing the cremated remains.

Turning to FIG. 6, there is shown an alterative sealable vessel or container 120. The sealable vessel or container 120 is flexible, for example a plastic pouch or the like, and comprises a side wall portion 122 and a bottom wall 124, which forms the sealable vessel 120. The sealable vessel 120, which has an opening for insertion of the cremated remains 30, is sized to contain the cremated remains 30 of the deceased.

The upper portion of sealable vessel 120 forms a sealable entry or opening 128. The opening 128 is capable of sealed closure by means of a plastic zipper or a smooth interlocking "zip-lock" type fastener or can be heat sealed to permanently close the opening 128. In operation the empty vessel 120 is filed with cremated remains 30 of the deceased pet from the opening 128 in top portion of the sealable vessel 120. The opening 128 is then sealed as aforementioned, and the vessel is inserted into chamber 14 as here before described.

Figure 7:
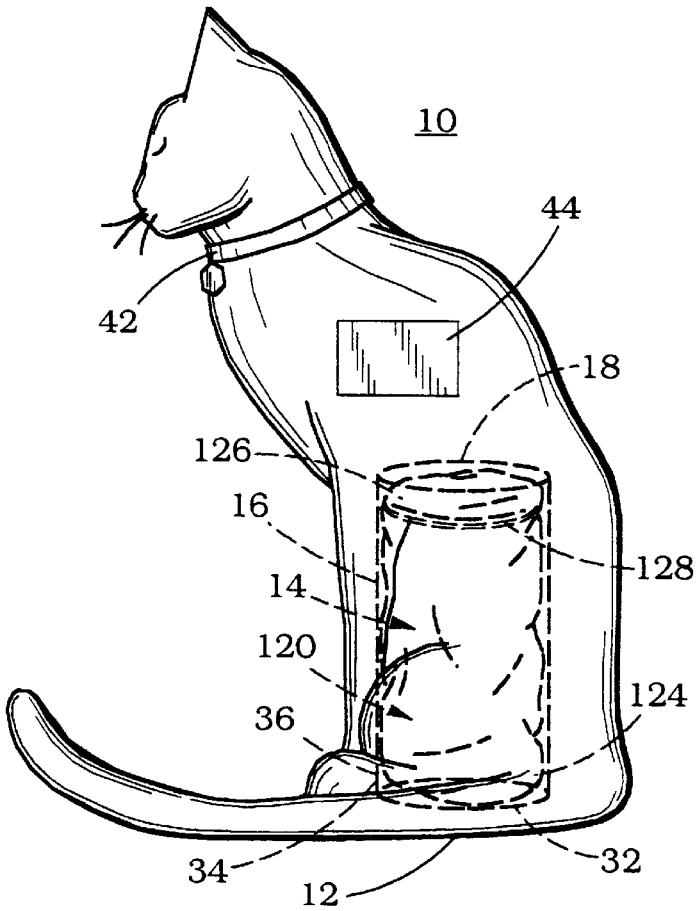
FIG. 7 is a side perspective view of the pet crematory urn with a memorabilia collar attached.

Turning to FIG. 7, there is shown a pet cremation urn 10 in the general form of a cat according to the present invention comprising a base section 12 and a chamber 14 within torso portion of urn 10. The chamber 14 comprises a side wall cylindrical portion 16 and a top wall 18 which form the internal chamber 14 within the pet cremation urn 10. The chamber 14, which is open at its bottom portion is sized to contain either the container 20 (not shown), the container 120, or the cremated remains 30 of the deceased (not shown).

The cremated remains 30 are housed in a sealed vessel 120, which is adapted to fit in chamber 14 as seen in FIG. 7. The sealable vessel or container 120 contains the cremated remains 30 of the deceased.

The lower portion of chamber 14 forms a threaded female connector 36 which receives a chamber male connector screw plug 32 having a male treaded portion 34 into the base section 12. Thus, the sealed vessel 120 containing cremated remains 30 is inserted into chamber 14 and chamber male connector screw plug 32 is rotatably tightened to form a sealed chamber 14 containing vessel 120 with cremated remains 30 as seen in FIG. 7. In accordance with another embodiment a collar 42 of the deceased can be placed about the neck portion of the urn 10. In still a further embodiment, a smoothed or otherwise finished portion 44 on urn 10 present a memorabilia site for any suitable inscription in regard to the birth, life, character, and death of the pet, or a picture, plaque or the like. Urn 10 can also contain a receptacle, hollow or compartment (not shown) to house or store memorabilia.

The receptacle or urn 10 may be made of cast material or the usual alloys for casting statues, such as bronze and the like; but is preferably of marble. The container is preferably a molded, stamped or extruded metal or hard plastic capable of turning threads therein. The ashes of the dead pet are thus not only securely preserved in a manner by which they can be readily retained by owners and friends in the household, but are so kept that their presence will recall only a pleasing recollection of the departed.

Instead of forming the statue in the likeness of the deceased pet whose ashes it is to hold, it is evident that it may represent some other animal figure or portions of the figure, or it may, if desired, be allegorical in character, as deemed appropriate.

Although for purposes of illustration certain material and sizes have been defined herein, those skilled in the art will recognize that various modifications to the same can be accomplished without departing from the spirit of the present invention and such modifications are clearly contemplated herein.

What is claimed is:

1. A pet crematory urn for storing the cremated remains of a deceased pet comprising:

a) a decorative housing in the general form of the deceased pet having therein a partially internally threaded sealable chamber means for adaptively receiving at least one sealable container means for storing the cremated remains of said deceased pet;

(b) said at least one sealable container means having an opening for receiving the cremated remains of the deceased pet;

(c) means for closing said at least one sealable container means; and (d) threaded plus means for closing said sealable chamber wherein said threaded plug means engages said partially internally threaded sealable chamber and is adapted to support a portion of said at least one sealable container.

2. The pet crematory urn of claim 1 wherein said decorative housing is in the likeness of the deceased pet whose cremated remains are to be placed in said at least one sealable container means for storing said cremated remains of said deceased pet.

3. The pet crematory urn of claim 1 wherein said decorative housing forms therein a surface for attaching memorabilia of the deceased pet to the urn.

4. The pet crematory urn of claim 1 wherein said chamber has an opening disposed in a base of said urn.

5. The pet crematory urn of claim 1 wherein said at least one sealable container means for storing said cremated remains of said deceased pet is rigid with a lid.

6. The pet crematory urn of claim 1 wherein said at least one sealable container means for storing said cremated remains of said deceased pet is flexible with said opening being sealable.

7. The pet crematory urn of claim 1 wherein said urn is adapted to receive a pet collar.

8. In combination a pet crematory urn for storing the cremated remains of a deceased pet and the cremated remains of said pet comprising:

a) a decorative housing in the general form of the deceased pet, having therein a sealable chamber adapted to receive at least one sealable container for storing the cremated remains of the deceased pet;

(b) said at least one sealable container having an opening for receiving the cremated remains of the deceased pet;

(c) means for closing said at least one sealable container; and (d) means for closing said sealable chamber.

9. The combination pet crematory urn claim 8 wherein said at least one sealable container for storing the cremated remains of the deceased pet is rigid with a lid.

10. The combination pet crematory urn of claim 8 wherein said at least one sealable container for storing the cremated remains of the deceased pet is flexible with said opening being sealable.

11. The combination pet crematory urn of claim 8 wherein said chamber has an opening disposed at the base of said pet crematory urn.

12. The combination pet crematory urn of claim 8 wherein said decorative housing forms therein a surface for attaching memorabilia of said deceased pet to said pet crematory urn.

13. The combination pet crematory urn of claim 8 wherein said pet crematory urn is adapted to receive a pet collar.

* * * * *